United States Patent [19]

Tanzilli

[11] 4,011,703

[45] Mar. 15, 1977

[54] BUILDING ELEMENT FOR MAKING INSULATING PANELS AND PANELS ASSEMBLED THEREFROM

[76] Inventor: Umberto Tanzilli, Via Ippolito Nievo 1, Sora, Frosinone, Italy

[22] Filed: June 25, 1975

[21] Appl. No.: 590,263

[30] Foreign Application Priority Data

June 27, 1974 Italy ..... 12205/74

[52] U.S. Cl. ..... 52/618; 52/343; 52/666; 52/309.1; 52/100

[51] Int. Cl.[2] ..... E04C 2/42

[58] Field of Search ..... 52/343, 666, 664, 98, 52/100, 732, 668, 579, 618, 309, 615; 428/226, 225

[56] References Cited

UNITED STATES PATENTS

| | | | |
|---|---|---|---|
| 297,631 | 4/1884 | Plimsoll | 52/664 |
| 533,813 | 2/1895 | Hull | 52/664 |
| 2,620,862 | 12/1952 | Hite | 52/664 |
| 2,910,152 | 10/1959 | Edgar | 52/618 |
| 3,623,936 | 11/1971 | Hotz | 52/668 |
| 3,698,145 | 10/1972 | Newman | 52/618 |
| 3,708,929 | 1/1973 | Estes | 52/98 |
| 3,804,196 | 4/1974 | Horn | 52/145 |

FOREIGN PATENTS OR APPLICATIONS

| | | | |
|---|---|---|---|
| 1,003,164 | 3/1952 | France | 52/618 |
| 725,639 | 2/1944 | France | 428/226 |
| 282,050 | 6/1931 | Italy | 52/664 |
| 530,029 | 12/1940 | United Kingdom | 52/145 |

*Primary Examiner*—Price C. Faw, Jr.
*Assistant Examiner*—Henry Raduazo

[57] ABSTRACT

The invention provides building elements for making floor or wall panels. Each element has a plurality of upper plates and a plurality of lower plates, the plates being aligned, parallel and staggered, with interconnecting webs between the upper and the lower plates, respectively. Several elements are interwoven and bonded to make a panel having a face comprising the upper plates and a back comprising the lower plates. Posts projecting from the back faces of the upper plates improve the strength of the panel.

6 Claims, 5 Drawing Figures

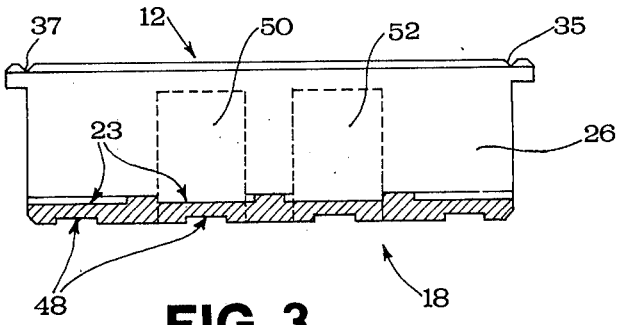
FIG. 3
FIG. 5
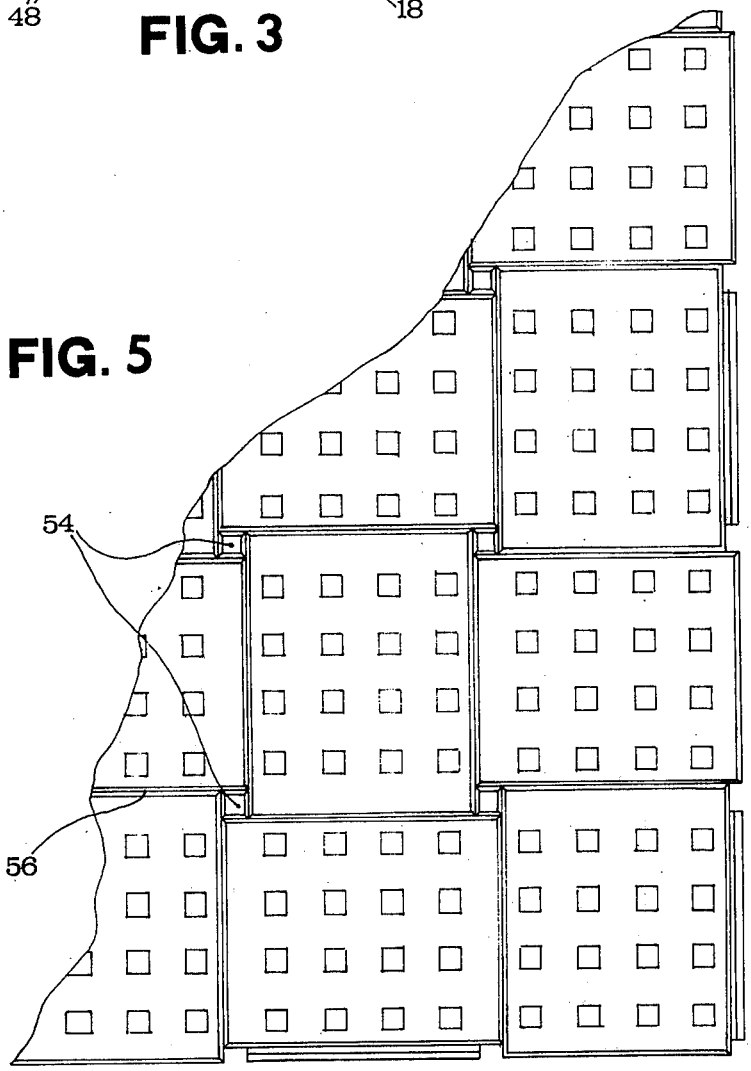

BUILDING ELEMENT FOR MAKING INSULATING PANELS AND PANELS ASSEMBLED THEREFROM

This invention relates to building elements adapted to be assembled to form insulating panels for making floors and walls. More particularly, the panels have improved inherent thermal, electrical and acoustic insulation properties and are adapted for making highly insulated floors or walls in residential and industrial buildings as well as in mobile structures such as railway carriages and the like. The invention is particularly useful for making electrically insulated floors in electric power plants and stations and the like.

Where floors or walls having unusually good insulation properties, either to electricity, heat and/or sound are required, special additional layers of a material having the desired property are incorporated into the thickness of the floor or wall. Generally such added materials will present only one of the desired characteristics and will usually lack a satisfactory strength or impact resistance: these properties have to be provided by conventional materials. Consequently, prior floors are either poor in one or more respects or are excessively expensive.

Accordingly, it is a main object of this invention to provide building elements for making floor and wall panels having excellent insulation properties as well as high strength and impact resistance.

A further object of the invention is to provide such elements which can be integrally cast or molded for a cheap high speed mass production.

Another object of the invention is to provide floor panels having all the above-mentioned desirable properties while employing a minimum of expensive materials.

A further important object of the invention is to provide floor panels having a very high electrical insulation, thus permitting insulated floors for electric power stations to be manufactured.

The above and other objects and advantages of the invention, such as will appear from the following description, are achieved by means of building elements, each comprising a plurality of identical first substantially square plates, said first plates being arranged in a coplanar, spaced rectilinear row, each space between successive first plates being equal to the length of a first plate in the direction of the length of the row; a plurality of identical second, rectangular plates, said second plates being arranged in a coplanar, spaced rectilinear row, each of the second plates being aligned, in a direction at right angles to the longitudinal axis of the row, with one of the spaces between successive first plates, the second plates being slightly narrower than the first plates; a plurality of rigid webs, each interconnecting adjacent edges of a first and a second plate, respectively, the webs being at right angles to the planes of the plates, and each web lying entirely within the periphery of the associated first plate; a first and a second end wall, extending at right angles from the terminal edge of a first and a second plate, respectively, parallelly to the webs.

In the drawings:

FIG. 3 is a transverse cross-section on an enlarged scale taken along line III—III of FIG. 1;

FIG. 5 is a fragmentary view from the underside of the panel of FIG. 4.

In the following description, terms such as "upper", "lower", "vertical" refer to the position of an element when part of a completed panel set in a floor, and should not be understood in a limiting sense.

Figure 1:
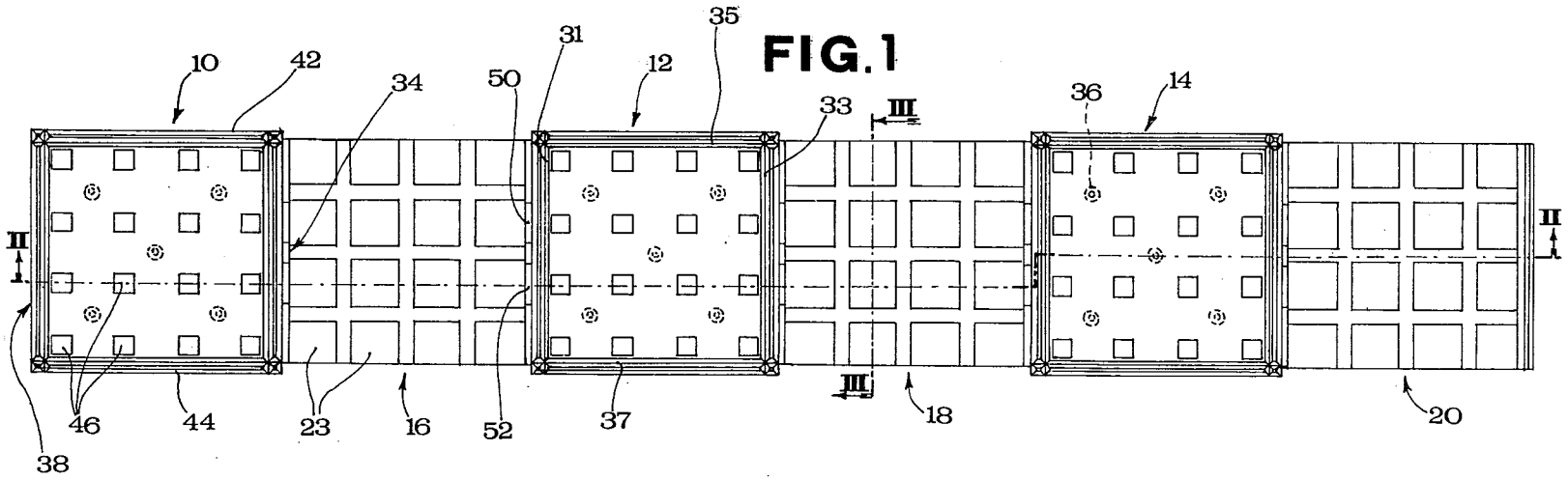
FIG. 1 is a plan view of a preferred embodiment of a building element according to the invention.
Figure 2:
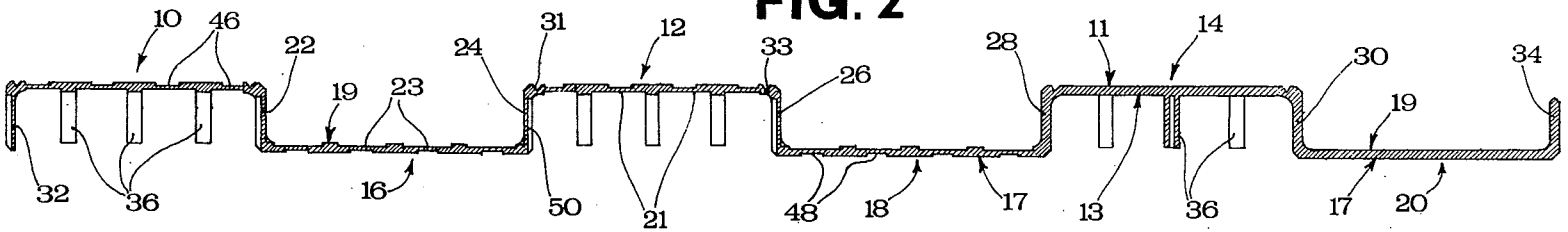
FIG. 2 is a longitudinal cross-section taken along line II—II of FIG. 1.

With reference to FIGS. 1, 2 and 3 of the drawings, a building element according to the invention comprises three identical substantially square upper or tile plates 10, 12, 14, arranged in a coplanar rectilinear row; three identical, rectangular lower or base plates 16, 18, 20 arranged in a coplanar row which is spaced from, parallel to and aligned with the row of upper plates; five interconnecting cross webs or walls 22, 24, 26, 28, 30 each extending at right angles to the planes of the parallel rows of plates to connect adjacent sides of adjacent plates of different rows; and two end walls 32, 34 extending at right angles, or parallelly to the cross webs, from the end sides of plates 10 and 20.

The entire building element comprising upper and lower plates, webs and end walls is integrally molded in a material such as synthetic resin, preferably impact resistant PVC.

More particularly, each of the upper or tile plates 10, 12, 14 is substantially square in plan view, but their transverse sides 38, 40 are preferably slightly shorter, by about 2 mm, than the longitudinal sides 42, 44 for purposes explained in the following. The distance between successive tile plates in a row is equal to the length of its longitudinal sides. Each tile plate has a front face 11 and a back face 13. In a particularly preferred embodiment, the longitudinal sides are 180 mm long, while the transverse sides are 178 mm long.

Each of the upper plates 10, 12, 14 is preferably formed with uniformly spaced recesses such as 46 in its front face 11 which serve to impart non-skid properties to the finished panel. A plurality of posts such as 36 project at right angles from each back face 13 of the plates. The posts 36 are integral with the associated plate, are preferably cylindrical and hollow and are preferably five in number.

Each of the upper plates 10, 12, 14 is bevelled along the periphery of its front face. Grooves such as 31, 33, 35, 37 extend parallelly to each side of each tile plate on the front face of the plate, a few millimeters from the bevel. The grooves have the purpose of forming a raceway for guiding a conventional hot-air bonding machine during assembly of a panel, as explained later.

Each of the base plates 16, 18, 20 has a length equal to the length of an upper plate, while its width is about 6 or 7 percent shorter than its length. In a preferred example, the length is 180 mm, while the width is 168 mm, i.e. 12 mm shorter than the length. Each of the base plates has a front face 17 and a back face 19 and is formed with uniformly spaced recesses 48 on its front face 17, similarly to the front faces of the tile plates, with the purpose of improving adherence to a support (not shown).

Both the tile plates and the base plates preferably have larger recesses 21, 23 on their back faces 13, 19, respectively.

The webs 22, 24, 26, 28 and 30 extend at right angles to both the tile and base plates. Each of the webs lies entirely within the periphery of the associated tile plate and externally to the periphery of the associated base plate. Each web 22–30 is as long as a post 36 between the planes defined by the back faces of the tile plates and the base plates, respectively. Two weakened areas such as 50, 52 are provided in each of the webs for allowing the web to be easily smashed locally for providing an aperture for passage of electrical conductors, pipes and the like. The preferred thickness is 6 mm.

The end walls 32, 34 are similar to the webs, in that they extend at right angles from the associated plates, and lie within the periphery of the associated plate.

Figure 4:
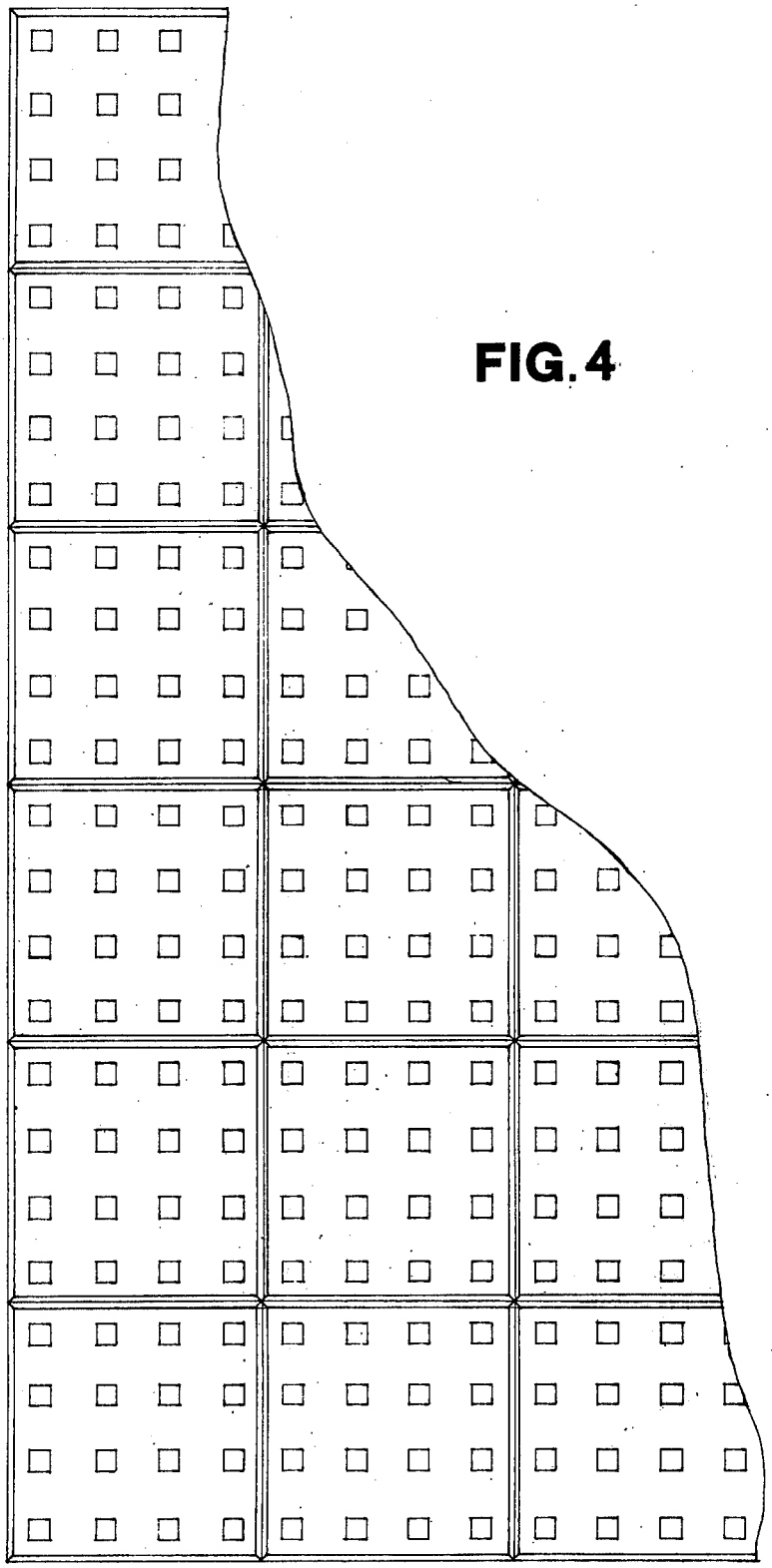
FIG. 4 is a fragmentary top plan view of a panel assembled from a set of 12 elements as shown in FIGS. 1, 2 and 3.

A panel is formed by interweaving six parallel identical elements as disclosed above with six further parallel identical elements at right angles to the former. The tile plates of one set will fit easily in the spaces over the base plates of the other set thanks to the small clearance (about 1 mm) preferably provided by the slight difference of the longitudinal and transverse sides of a tile plate. One face of the panel will therefore be a square mosaic of 36 tile plates, as shown in FIG. 4.

The opposite face of the panel will be a mosaic of 36 base plates as shown in FIG. 5. Since the base plates are appreciably narrower than the length of the space allowed for them in the interweaving with other building elements, square gaps will be left at the corners of each four intersecting elements. The gaps are preferably plugged by means of inserts 54 of the same material as the building elements.

When a panel has been thus assembled, it is then bonded along the junctions among the tile plates and the base plates, respectively. This is preferably done by means of a conventional bonding machine. The grooves 31, 33, 35, 37 as well as the junctions 56 between two adjacent base plates serve as guiding tracks for the bonding machine to allow the operation to be carried out easily and speedily.

After bonding, the panel is milled clean of flashes resulting from the bonding step, and, if the bonding material is of the same color as the elements themselves, the bonded junctions will be invisible.

If desired, a material such as fiberglass, foamed plastics or the like may be incorporated between the elements of a panel during assembly, in order to further improve its insulation properties, especially acoustic insulation. Openings for the passage of ducts such as water pipes, electric cables or the like can easily be provided in a floor or wall made with panels as described above by providing corresponding apertures in the end walls and webs of adjacent panels, as mentioned above.

The face of the finished panel comprising the tile plates can be used as the finished tread surface for a floor, or can be further carpeted if a more refined appearance is desired.

Although building elements each having three tile plates and three base plates have been described, it will be understood that a different number of them might be provided. Also the size of the individual plates might be different. The number and shape of the recesses in the plates may vary, as well as the number and shape of the posts. These could also be replaced by intermediate webs or other kinds of supporting structure.

What is claimed is:

1. A plastic building element comprising a plurality of identical first substantially square plates arranged in spaced relationship in a first coplanar rectilinear row, the spacing between successive first plates being equal to the longitudinal dimension of said first plates; a plurality of identical second rectangular plates arranged in spaced relationship in a second coplanar rectilinear row spaced from, parallel to, and aligned with said first row, the longitudinal dimension of said second plates and the spacing between successive second plates being equal to the longitudinal dimension of said first plates, and the transverse dimension of said second plates being less than the transverse dimension of said first plates; and a plurality of webs respectively connecting the adjacent edges of a first plate and a second plate, each web being perpendicular to said first row and said second row, and each web lying entirely within the edge of its associated first plate and externally of the edge of its associated second plate.

2. A plastic building element according to claim 1, in which the number of first plates is equal to the number of second plates, and which includes a first end wall extending perpendicularly from the terminal edge of the terminal first plate and a second end wall extending perpendicularly from the terminal edge of the terminal second plate, said end walls being parallel to and aligned with the webs, and such end wall lying within the terminal edge of its associated plate.

3. A plastic building element according to claim 1, which includes a plurality of posts extending perpendicularly from the inner surface of each first plate for a distance corresponding to the spacing between the rows of plates.

4. A plastic building element according to claim 1, in which the outer surface of each first plate is provided with a groove running parallel to and near each edge of such first plate, each groove extending the full length of its associated edge, for the purpose of receiving and guiding a plastic-bonding tool.

5. A panel comprising a plurality of interwoven longitudinally positioned and transversely positioned plastic building elements according to claim 1; said respective building elements being so arranged that each first plate of a longitudinally positioned element overlies a second plate of a transversely positioned element and each first plate of a transversely positioned element overlies a second plate of a longitudinally positioned element, with the webs extending from each such first plate engaging the longitudinal edges of the associated overlain second plate; the first plate of each element being plastic-bonded to its respective adjacent first plates; and the second plate of each element being plastic-bonded to its respective adjacent second plates.

6. A panel according to claim 5, which includes plastic inserts respectively plugging the openings occurring at the corners of adjacent second plates, each such plastic insert being bonded to its respective adjacent second plates.

* * * * *